US006219971B1

(12) United States Patent
Headrick

(10) Patent No.: US 6,219,971 B1
(45) Date of Patent: Apr. 24, 2001

(54) JAMB AND THRESHOLD ASSEMBLY WITH WATERTIGHT SEALS

(75) Inventor: J. Charles Headrick, Alpharetta, GA (US)

(73) Assignee: Endura Products, Inc., Colfax, NC (US)

( * ) Notice: Subject to any disclaimer, the term of this patent is extended or adjusted under 35 U.S.C. 154(b) by 0 days.

(21) Appl. No.: 09/351,476

(22) Filed: Jul. 13, 1999

Related U.S. Application Data

(60) Provisional application No. 60/092,548, filed on Jul. 13, 1998.

(51) Int. Cl.[7] ..... E06B 1/70
(52) U.S. Cl. ..... 49/469; 49/475.1
(58) Field of Search ..... 49/467, 468, 469, 49/471, 475.1, 504

(56) References Cited

U.S. PATENT DOCUMENTS 3,851,420 * 12/1974 Tebbetts ..... 49/471
4,055,917 * 11/1977 Coller ..... 49/469
4,310,991 * 1/1982 Seely ..... 49/471 X
4,974,366 * 12/1990 Tizzoni ..... 49/504

* cited by examiner

*Primary Examiner*—Jerry Redman
(74) *Attorney, Agent, or Firm*—Womble Carlyle Sandridge & Rice

(57) ABSTRACT

An apparatus for providing a watertight seal at the bottom corners of an entryway is provided. The apparatus includes a flexible pad at each of the bottom corners of the opening where the side jambs meet the threshold cap. The pads extend partially behind the weather strip and are formed with a projection that extends between the legs of the weather strip. The weather strip is thus reinforced and held firmly against the bottom corners of a closed door, the front of the threshold cap beneath the door, and the space therebetween. A secure watertight seal is thus created.

8 Claims, 4 Drawing Sheets

JAMB AND THRESHOLD ASSEMBLY WITH WATERTIGHT SEALS

REFERENCE TO RELATED APPLICATION

This application claims the benefit of the filing date of pending U.S. provisional application serial No. 60/092,548 filed Jul. 13, 1998.

TECHNICAL FIELD

The present invention relates generally to entryways and more particularly to a jamb and threshold assembly that forms a watertight seal at the bottom corners of the assembly when the door of the entryway is closed.

BACKGROUND OF THE INVENTION

Sealing a closed entryway against the leakage of water has long been a problem for designers of such entryways. The problem is particularly acute in a blowing rain storm, where the wind can easily blow rain water between a closed door and the jamb or threshold of the entryway. One common location for such leakage to occur is at the bottom corners of the door where the vertical jambs of the entryway meet the threshold cap of the sill assembly. This is because water tends to collect in these corners during a blowing rain storm and can be blown between the lower corners of the door and the jamb and into the building. While modern weather stripping seals well around most of the periphery of the door, it has nevertheless not proven effective at the bottom corners of the door where the weather stripping spans the space between the bottom of the door and the door sill assembly. Accordingly, there exists a need for a method and apparatus for providing a watertight seal at the bottom corners of an entryway door when the door is closed. It is to the provision of such a method and apparatus that the present invention is primarily directed.

SUMMARY OF THE INVENTION

The present invention, in one preferred embodiment thereof, comprises a door jamb and threshold assembly that forms a watertight seal at the bottom corners of a door when the door is closed. The assembly comprises a pair of spaced vertical side jambs and a door sill and threshold assembly that spans the bottom ends of the jambs. A head jamb spans the tops of the side jambs to frame the opening. Flexible rubber or foam weather stripping is provided around the periphery of the opening and is positioned so that it becomes compressed between the stop of the jambs and a closed door to provide a seal around the periphery of the door.

A rubberized or foam pad is fixed to the side jambs at each of the bottom ends thereof where the jamb meets the threshold and sill assembly. The pad has a tapered portion that is positioned to be compressed between the bottom of the outside vertical edge of the door and the door jamb when the door is closed to provide a seal. In addition, the pad includes a projection that is positioned between the fixed and flexible legs of the weather stripping at the bottom corners of the side jambs. When the entryway door is closed, the weather stripping seals around the perimeter of the door as usual. At the bottom corners of the door, the projections of the pads between the legs of the weather stripping reinforces the weather stripping in this region causing it to bear with greater force and seal better against the door.

A portion of the projection formed as a part of the pad extends downwardly beyond the lower extent of the door to reinforce the weather stripping that rests against the front edge of the threshold cap beneath the closed door. Thus, when the door is closed, the weather stripping at the bottom corners of the door is compressed tightly against the door and the continuation of the weather stripping below the door is compressed tightly against the front of the threshold cap. In addition, the portion the weather stripping that spans the space between the bottom of the door and the threshold cap is pressed into and conforms to the shape and contours of the space. As a result, a watertight seal is formed at the bottom corners of the door and rain water is prevented from entering the dwelling, even in a blowing rain storm. These and other features, objects, and advantages of the present invention will become more apparent upon review of the Detailed Description set forth below taken in conjunction with the accompanying drawings, which are briefly described as follows.

DETAILED DESCRIPTION OF THE PREFERRED EMBODIMENTS

Figure 1:
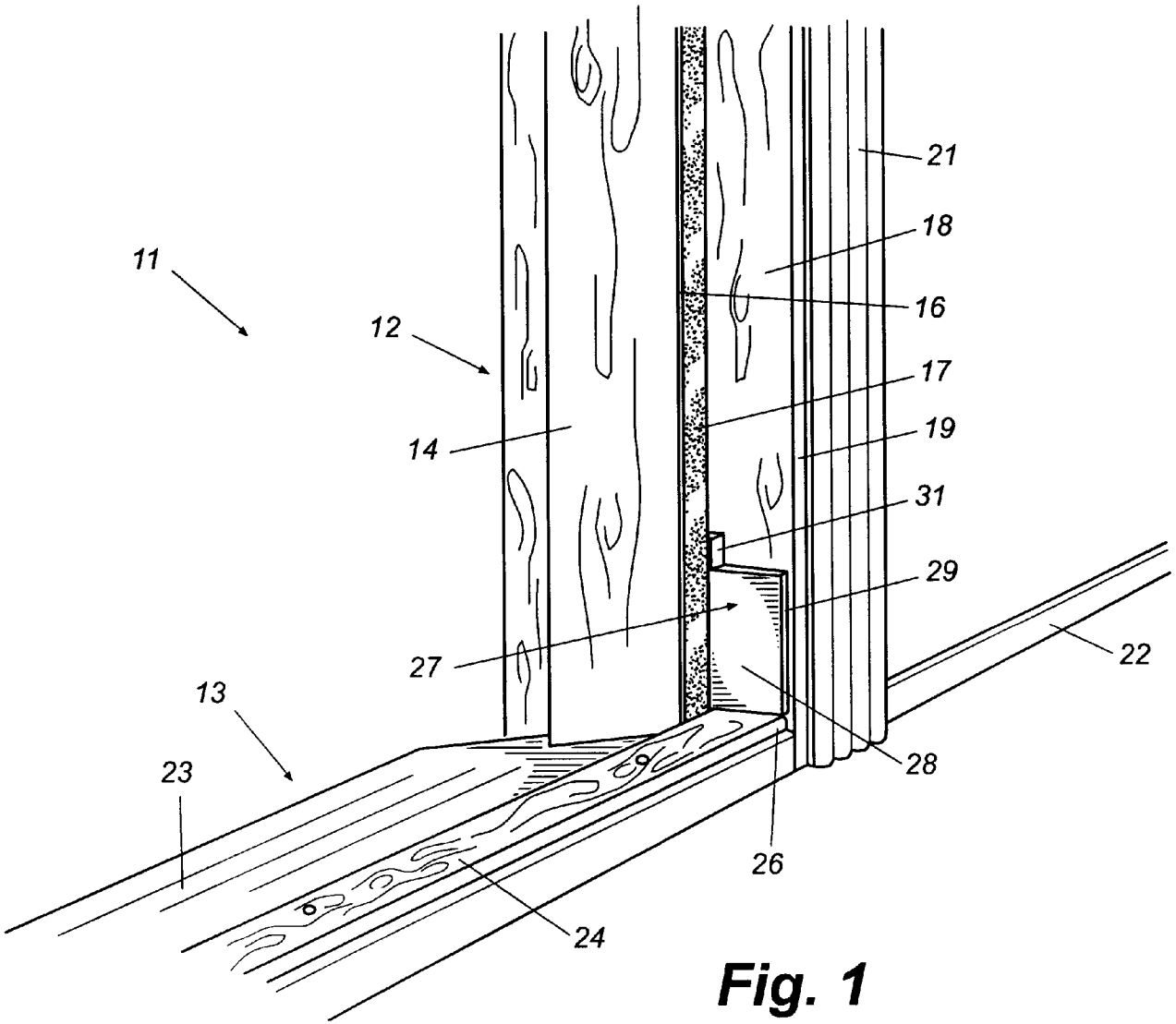
FIG. 1 is a perspective view of the bottom corner of a jamb and threshold assembly illustrating the configuration and placement of a sealing pad that embodies principles of this invention in a preferred form.

Referring now in more detail to the drawings, in which like numerals refer to like parts throughout the several views, FIG. 1 illustrates a door jamb and threshold assembly that embodies principles of this invention in a preferred form. The door jamb and threshold assembly 11 comprises a vertical side jamb 12 and a horizontal threshold and sill assembly 13 that is secured to the bottom of the side jamb 12. The threshold and sill assembly 13 has a downwardly sloped outside sill 23 for the drainage of water and a threshold cap 24 that underlies a closed door of the entryway framed by the jamb and sill assembly. It will be understood that a second vertical side jamb (not shown) is spaced from the jamb 12 on the other side of the entryway to form, along with the head jamb, the entryway opening. The present invention preferably is applied at both of the bottom corners of the entryway opening to provide a seal at both locations, although it ay be applied to only one corner if desired.

The vertical jamb 12, which can be milled of wood, formed of extruded plastics, or be fabricated from a combination of materials, is configured to define a vertical support member 14 that forms a raised stop 16 with respect to an inset surface 18 of the jamb. The jamb has an inside edge 19 and decorative casing 21 is shown attached to the jamb. In a typical installation, baseboard 22 abuts the bottom of the decorative casing 21.

A weather strip 17 is mounted to the jamb and extends around the inside periphery thereof along the stop. The weather strip 17 extends upwardly from the sill just in front of the threshold cap 24 and extends around the perimeter of the opening. The weather strip, which is described in more detail below, is a flexible foam or rubberized material that becomes captured and compressed between a closed door and the stop 16 to form a weather seal around the periphery of the door.

A sealing pad 27, configured according to the principles of this invention, is secured to the inset surface 18 of the jamb 12 at the bottom end thereof where the jamb meets the threshold cap 24. The sealing pad 27, described in greater detail below, has a tapered body with an exposed surface 28 and an inside edge 29. The sealing pad 27 is formed with a projection that extends behind the weather strip 17 to reinforce the weather strip and provide a watertight seal as described in detail below.

Figure 2:
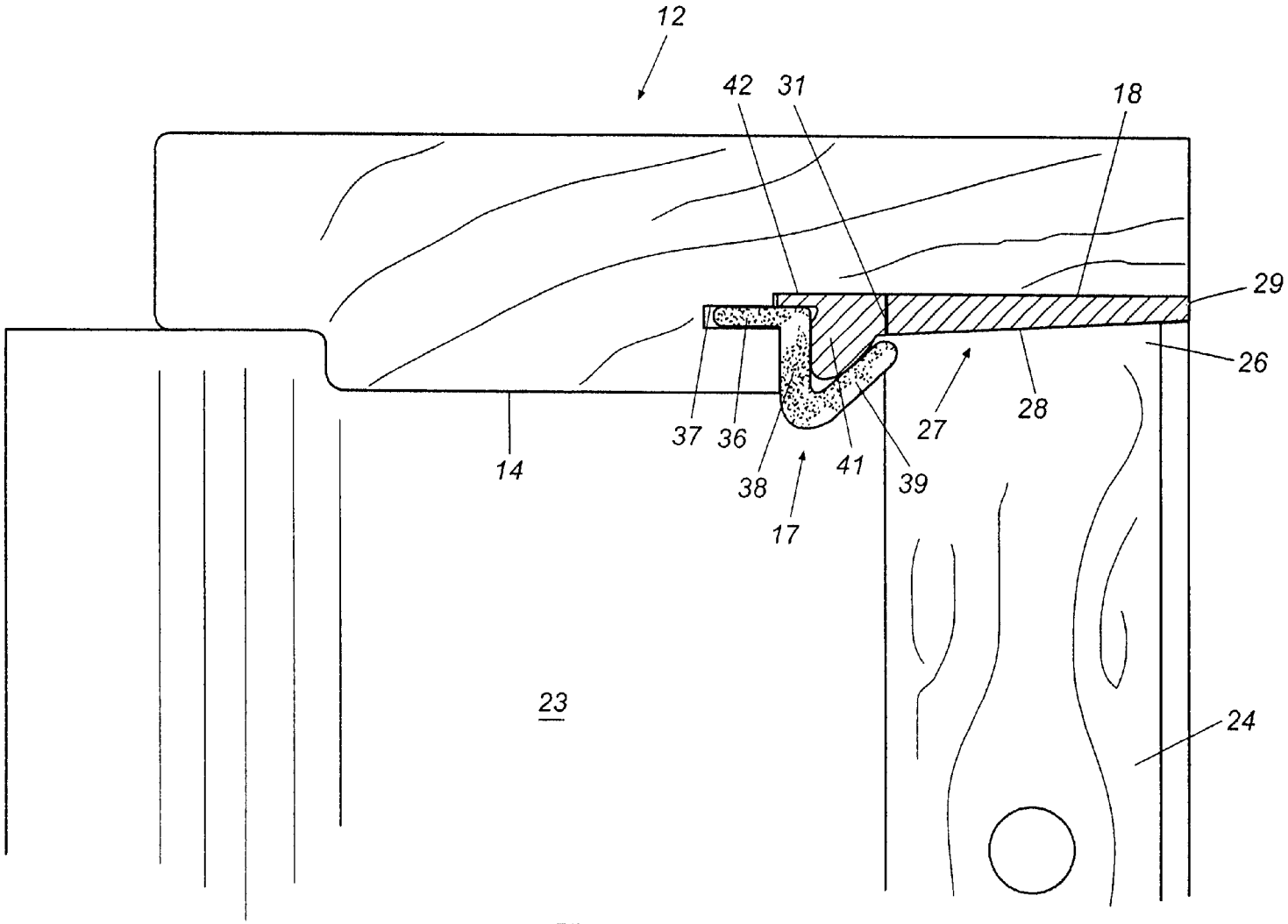
FIG. 2 is a top cross-sectional view of the assembly of FIG. 1 taken through the sealing pad.
Figure 3:
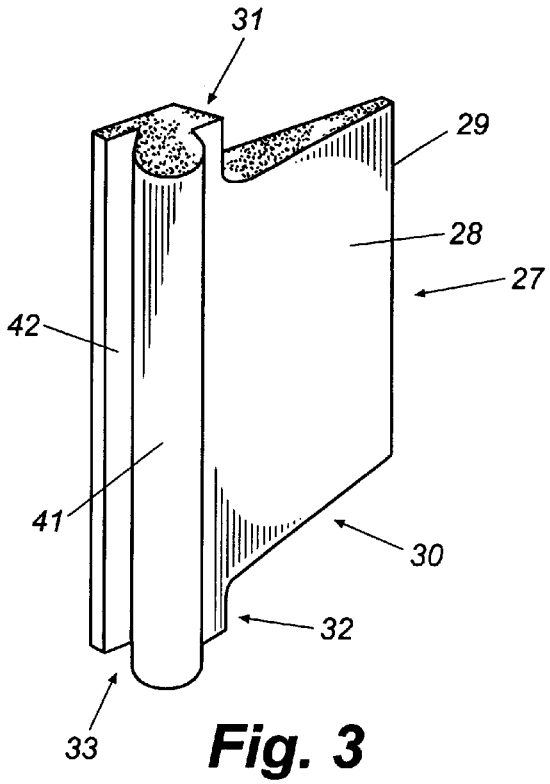
FIG. 3 is a perspective view of a sealing pad that embodies principles of the invention in a preferred configuration.

FIG. 2 illustrates the configuration and function of the sealing pad 27 in greater detail. The sealing pad 27 is seen to be fixed by an appropriate adhesive or the like to the inset face 18 of the door jamb assembly 12. The exposed surface 28 of the sealing pad faces inwardly and the body of the pad is tapered from a narrow inside edge 29 to a wider outside edge portion 42 (FIG. 3). The sealing pad 27 is further formed with an upwardly projecting ear 31 (best seen in FIG. 3)and a downwardly projecting ear 32. The bottom edge portion 30 of the sealing pad 27 is configured to conform to the shape of the threshold cap 24 with the downwardly projecting ear 32 extending in front of the outside surface of the threshold cap. Thus, it will be seen that the bottom 33 of the downwardly projecting ear 32 rests against the sill 23 in front of the threshold cap.

As best seen in FIG. 2, the outside edge portion 42 of the sealing pad 27 extends behind the weather strip 17 of the assembly. An elongated lobe or projection 41 is formed along the outside edge portion 42 of the sealing pad. The projection 41 is shaped and positioned to be disposed between the fixed leg 38 and the flexible leg 39 of the weather stripping. In this way, the weather stripping is reinforced and stiffened by the projection 41 at the bottom corners of the entryway.

Figure 4A:
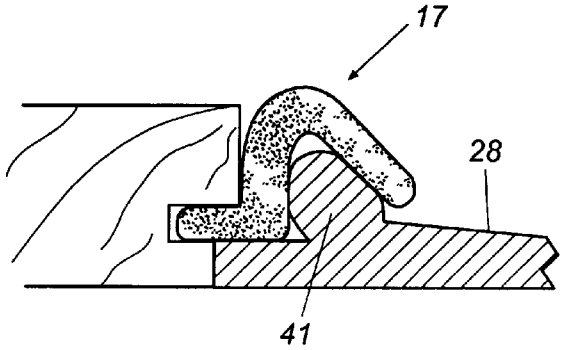
FIGS. 4*a* and 4*b* illustrate alternate embodiments of the sealing pad that forms part of this invention.
Figure 4B:
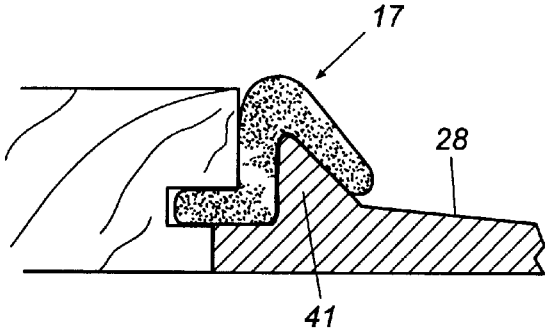

While FIGS. 2 and 3 illustrate a sealing pad 27 having an elongated projection 41 that is generally cylindrical in shape, other shapes of the projection are obviously possible. The cylindrical shape of the preferred embodiment is shown in FIG. 4*a*. However, in FIG. 4*b*, the projection 41 is seen to be generally cone shaped to conform to the space between the fixed and flexible legs of the weather stripping 17. Many other shapes of the projection 41 are possible and are contemplated to be within the scope of the present invention.

Figure 5:
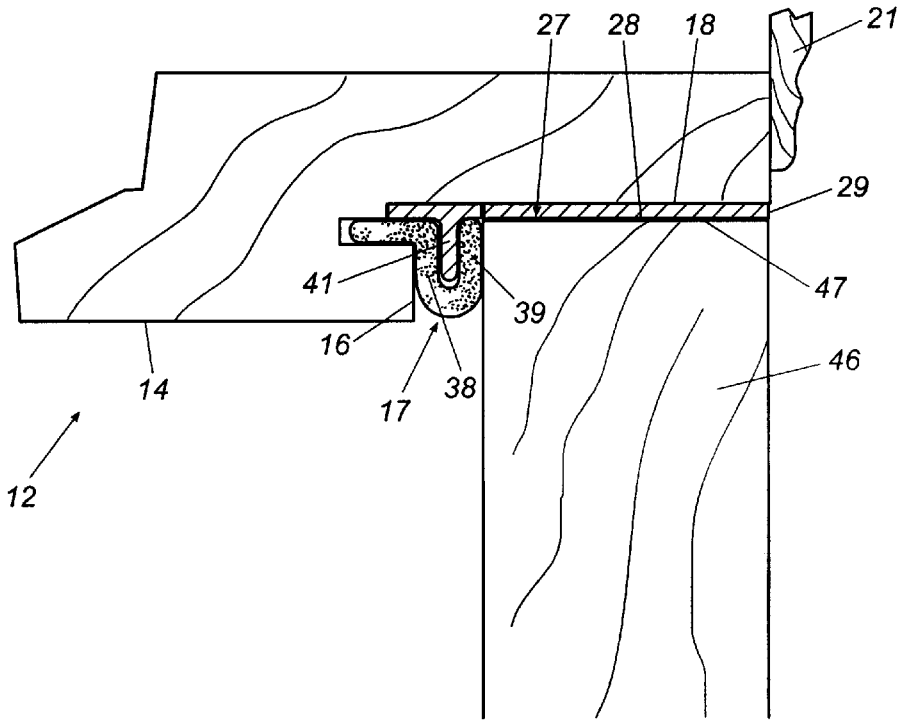
FIG. 5 is a top cross-sectional view of the assembly shown in FIG. 1 illustrating a door closed against the weather stripping and sealing pad.

FIG. 5 illustrates the function of the present invention when a door 46 is closed in the entryway. The sealing pad 27 is seen to have been compressed between the outside edge 47 of the door and the inset surface 18 of the jamb, thus providing a seal between the door and the jamb. The weather strip 17 is seen to be captured and compressed between the door 46 and the stop 16 formed in the jamb. The projection 41 formed on the sealing pad 27 is captured and compressed between the fixed leg 38 and the flexible leg 39 of the weather stripping. Since the sealing pad 27 and its projection 41 preferably are formed of a rubberized or foam material, this has the effect of reinforcing and substantially stiffening the weather strip 17 in the region of the bottom corner of the door. Thus, the weather strip 17 is compressed more tightly between the door 46 and the stop 16 to provide a dependable and reliable seal even against blowing rain.

Figure 6:
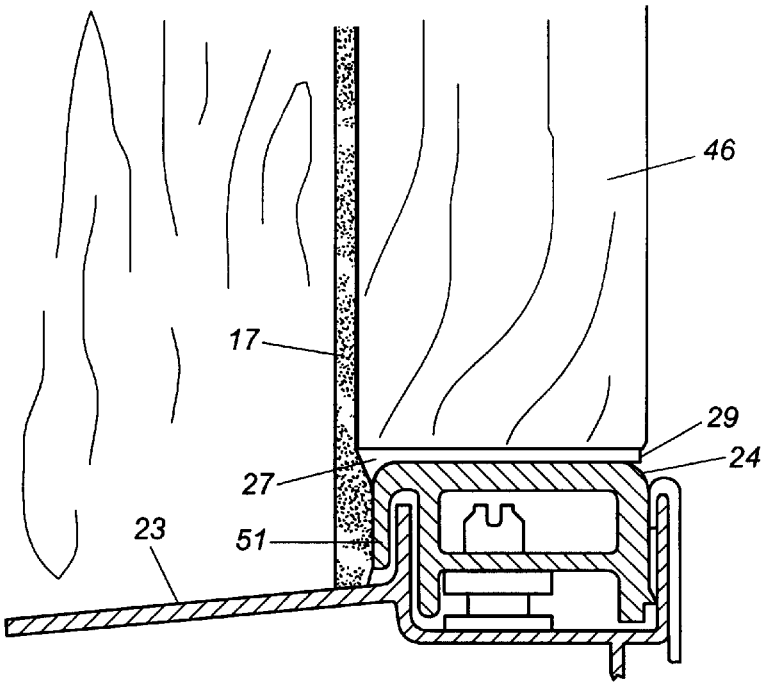
FIG. 6 is a side cross sectional view of the entryway showing the closed door and the water tight seal created by the present invention.

As illustrated in FIG. 6, the seal is completed by the downwardly projecting ear 32 of the sealing pad 27, which extends downwardly beyond the bottom edge of the door to the sill 23 itself. Thus, the weather strip 27 is reinforced and enhanced not only in the area where the weather strip meets the door but also in the area where the weather strip meets the front leg 51 of the threshold cap 24. The result is that when the door is closed, the weather strip is held firmly against the bottom corner of the door to provide a seal against the door and also is pressed and held firmly against the outside leg 51 of the threshold cap 24 to form a seal against the threshold cap. The reinforcement provided by the projection extending into the weather strip 17 causes the weather strip to be pressed against and conform to the shape of to the bottom edge of the door and also the front leg 51 of the threshold cap providing a watertight seal. In addition, the weather strip is also pressed tightly into the space between the door and the threshold cap to fill and seal this space as the door is shut and compresses the weather strip. The result is a water tight seal at the bottom corners of the threshold and sill assembly for preventing any seepage of rain water into the dwelling, even in a blowing rain storm.

The present invention has been described in terms of preferred embodiments and methodologies. Obviously, various additions, deletions, and modifications might well be made to the illustrated embodiments without departing from the spirit and scope of the invention. For example, the sealing pad of the invention has been illustrated as being formed of a rubberized or foam material. It might also be formed of other materials such as felt and might be formed from two or three or more individual components that make up the entire pad. It is the seal created between the door and the jamb and the enhancement of the weather strip that provides the advantages of the present invention and any physical configuration of the pad that performs this function and process is considered to be within the scope of the present invention. The process of the invention encompasses the steps of enhancing the weather stripping of the entryway at the bottom corner of the entryway to provide a seal. These and other modifications might well be made within the scope of the invention.

What is claimed is:

1. In an entryway having a hinged door with a free edge, a hinged edge, and an outside face; a pair of spaced jambs having a longitudinal stop formed therealong and being spanned at their bottom ends by a threshold assembly having a sill and a threshold cap; and a weather strip having a fixed leg and a flexible leg and being mounted to the spaced jambs extending along the stop, the flexible leg of the weather strip being compressed between the stop and the outside face of the door to form a seal when the door is closed; a sealing pad for mounting to the bottom end of at least one of the jambs adjacent the threshold assembly, said sealing pad being formed of compressible material and comprising:

a main body having an exposed surface positioned to engage and be compressed and seal between the jamb and one of the edges of the door when the door is closed;

an extension projecting from said main body toward said stop to a position beneath the weather strip; and a projection on said extension configured and positioned to project between the fixed leg and the flexible leg of the weather strip to reinforce and stiffen the weather strip at a lower corner of the entryway for enhancing the seal between the outside face of the door and the weather strip.

2. A sealing pad as claimed in claim 1 and further comprising an ear extending downwardly from said extension adjacent the threshold cap, said projection extending along said ear and projecting between the fixed and flexible legs of the weather strip in front of the threshold cap to compress the weather strip against and conform it to the threshold cap.

3. A sealing pad as claimed in claim 2 and wherein said main body is tapered.

4. A sealing pad as claimed in claim 3 and wherein said projection is bulbuous in shape.

5. A sealing pad as claimed in claim 2 and further comprising a second ear projecting upwardly from said extension such that said sealing pad is symmetrical for attachment to the bottom corner of either of the jambs.

6. An entryway comprising:

a pair of spaced vertical jambs having bottom ends and raised stops extending therealong;

a threshold extending between said bottom ends of said vertical jambs;

a door hingendly mounted to one of said vertical jambs, said door having vertical edges and a face, said face of said door abutting said stops when said door is closed;

a weather strip extending along each of said stops, said weather strip having a flexible leg that is captured and compressed between said face of said door and said stop when said door is closed to seal against said face of said door; and a sealing pad attached to said bottom end of at least one of said vertical jambs adjacent said threshold, said sealing pad having a first portion positioned to seal against said vertical edge of said door and a second portion projecting behind said flexible leg of said weather strip to reinforce said weather strip for an enhanced seal against said face of said door when said door is closed.

7. An entryway as claimed in claim 6 and wherein said threshold includes a threshold cap positioned to underlie said door when closed, said threshold cap having an upper surface and a forward edge substantially aligned with said stops, the bottom end of said weather strip being disposed between said forward edge of said threshold cap and said stops, said sealing pad including a third portion projecting behind said flexible leg of said weather strip at said bottom end thereof to reinforce the seal between said bottom end of said weather strip and said forward edge of said threshold cap.

8. A corner seal for sealing a bottom corner of an entryway where a vertical jamb, a threshold assembly, and a closed door having a face and vertical edges, and where the vertical jamb is formed with a longitudinally extending stop along which a weather strip having a flexible leg is disposed for engaging and sealing against the face of the door when the door is closed, said corner seal comprising a generally flat body portion formed of compressible material and having an exposed face and an outside edge, said body portion being attachable to a bottom end of the vertical jamb adjacent the threshold assembly for sealing against a vertical edge of the closed door and a compressible lobe projecting from said exposed face along said outside edge of said body portion, said projection being sized and shaped to extend behind the flexible leg of the weather strip to reinforce the weather strip and enhance the seal between the weather strip and the face of the closed door at a bottom corner thereof.

* * * * *